United States Patent [19]

Anderson

[11] Patent Number: 4,624,342

[45] Date of Patent: Nov. 25, 1986

[54] SCAFFOLDING PLATFORM

[76] Inventor: Carl E. Anderson, 12 St. Stephens Pl., Staten Island, N.Y. 10306

[21] Appl. No.: 847,211

[22] Filed: Apr. 2, 1986

Related U.S. Application Data

[62] Division of Ser. No. 714,931, Mar. 22, 1985, Pat. No. 4,598,794.

[51] Int. Cl.[4] ..... E04G 5/08

[52] U.S. Cl. ..... 182/223; 182/119; 182/131

[58] Field of Search ..... 182/119, 222, 223, 117, 182/118, 143, 145, 144, 128, 141, 130–132

[56] References Cited

U.S. PATENT DOCUMENTS

| | | | |
|---|---|---|---|
| 3,438,460 | 4/1969 | Solari | 182/222 |
| 4,352,597 | 10/1982 | Kay | 182/222 |
| 4,499,967 | 2/1985 | Anderson | 182/145 |
| 4,583,618 | 4/1986 | Zimmerman | 182/119 |

*Primary Examiner*—Reinaldo P. Machado
*Assistant Examiner*—Alvin Chin-Shue
*Attorney, Agent, or Firm*—Samson Helfgott

[57] ABSTRACT

A side rail system for interconnecting layered sections of elongated scaffold staging with the sections respectively spanning pairs of opposing upper and lower support arms of pump jacks which respectively ride on spaced apart pump jack poles. The side rail system includes upright posts which are spaced along the staging. A pair of rods are associated with each of the posts. The rods confrontingly project from the respective staging sections. The posts are pivotally coupled to the rods and are secured to the rods by quick adjust pins to prevent separation of the rods and posts. A mid-rail as well as a toe board can be interconnected between the rails. An end rail system can also be included. The scaffolding arrangement can be used exteriorly with a brace onto a wall. It can also be used interiorly between roof and floor with appropriate height adjustment arrangement provided.

4 Claims, 13 Drawing Figures

SCAFFOLDING PLATFORM

This application is a division of application Ser. No. 06/714,931 filed Mar. 22, 1985, now U.S. Pat. No. 4,598,794.

RELATIONSHIP TO OTHER APPLICATIONS

This invention relates to the following issued and pending U.S. applications all by the inventor of the present application. U.S. Pat. No. 4,382,488 issued May 10, 1983 for Pump Jack Poles; U.S. Pat. No. 4,432,435 issued Feb. 21, 1984 for Clamping Device; U.S. Pat. No. 4,446,945 issued May 8, 1984 for Brace For Securing A Pole To A Support Surface; U.S. Pat. No. 4,463,828 issued Aug. 7, 1984 for Pump Jack, and U.S. Pat. No. 4,499,967 issued on Feb. 19, 1985 for Scaffolding Staging.

BACKGROUND OF THE INVENTION

This invention relates to scaffolding systems, and more particularly to scaffolding supported on pump jacks and pump jack poles.

In numerous industries, it is necessary to erect scaffolding both internally as well as externally in order to permit workers to stand at an elevation above the ground surface. Typically, a scaffolding system is utilized in the installation of aluminum siding on the exterior of housing. Such scaffolding is typically erected by utilizing pump jack poles which are spaced apart and secured in spaced relationship to the house by means of a brace. Pump jacks are used to ride up and down the poles. The pump jacks typically include support arms on which are extended scaffolding staging. The workers can stand on the scaffolding staging and operate the pump jack to move the staging up and down along the pump jack poles.

The aforementioned U.S. Pat. No. 4,382,488 describes a novel pump jack pole formed of elongated hollow metal with a rubberized surface formed on only one side of the metal pole. Such poles were found to be extremely strong, long lasting, and easier to manipulate than the standard wooden poles. An improved brace was described in U.S. Pat. No. 4,446,845 for connecting the pump jack pole to a support surface such as a wall or roof of a housing. A clamp such as described in U.S. Pat. No. 4,432,435 can be used to interconnect the brace to the pole. The pump jack described in U.S. Pat. No. 4,463,828 includes improved features for safety purposes and for strength, such as the ability to release one of the shackles by means of a foot release and the use of an over-the center spring loaded handle to control the rolling down of the pump jack. The aforementioned U.S. Pat. No. 4,499,967 described an arrangement for interconnecting two elongated staging sections to permit colinear and coplanar connection of the sections in order to avoid accidents as workers move from section to section.

While the aforementioned novel features with regard to various aspects of the scaffolding systems have been useful, additional safety improvements are needed with respect to other aspects of the scaffolding system. For example, when utilizing an upper and lower layer of scaffolding staging, the space between such layers is generally open and can result in the accidental falling of the worker between the layers. Additionally, in interconnecting the scaffolding staging sections, there must be provided an efficient and safe manner for the worker to make the necessary connections between the scaffolding end staging sections.

In addition to utilization of the aforementioned patented equipment with regard to installation of aluminum siding, the equipment can also be utilized in other scaffolding needs. For example, in industrial or marine use, scaffolding is often required both internally and externally. In warehouses, where access to various layers of stored objects is required, the use of the pump jack and pump jack poles would be convenient. The platforming staging could be raised and lowered in order to reach the desired objects stored in the warehouse. Similarly, in marine applications, loading and unloading of ships, and other storage locations, could use the present pump jack and pump jack pole arrangement.

Accordingly, while the aforementioned patents and pending applications have provided great improvements in the utilization of pump jacks, pump jack poles, and related scaffolding equipment, additional features, modifications, and improvements are needed in order to even further extend the use of such equipment into the industrial and marine areas. Also, additional features are always warranted in order to improve the safety of such equipment.

SUMMARY OF THE INVENTION

Accordingly, it is an object of the present invention to provide improvements in the use of pump jacks and pump jack poles in connection with scaffolding equipment.

Another object of the present invention is to provide improvements in the use of pump jacks and pump jack poles to extend their capabilities into the industrial and marine area.

Still another object of the present invention is to provide a side rail system for interconnecting scaffolding sections supported on pump jacks.

A further object of the present invention is to provide a side rail system for a scaffolding arrangement which is easy to operate, provides safety benefits, and can be easily installed and removed from the scaffolding sections.

A further object of the present invention is to provide an improved coupling arrangement for interconnecting elongated staging sections of a scaffolding platform.

A further object of the present invention is to provide a coupling arrangement for connecting a section of scaffolding staging onto a support arm of a pump jack.

Still a further object of the present invention is to provide an end rail system for interconnecting scaffolding sections supported on pump jacks.

Another object of the present invention is to provide connecting arrangements for pump jack poles permitting their use internally so as to be placed between upper and lower support surfaces such as a ceiling and a floor.

Briefly, in accordance with the present invention, there is provided a side rail system for interconnecting layered sections of elongated scaffolding staging wherein the sections are positioned so as to span support arms and pump jacks. The support arms project in opposing directions so that the staging sections project in opposite directions from a common plane. The pump jacks respectively ride on spaced apart pump jack poles. The side rail system includes a number of upright poles which are spacedly positioned along the length of the staging. A pair of rods are associated with each of the posts. The rods extend into each of the staging sections and have an end projecting from the staging section. The posts are pivotally coupled at their distal ends to the respective projecting ends on the rods of the layered sections of scaffolding staging. Quick release pins are utilized to prevent separation of the posts and rods. A mid-rail as well as a toe board can be releasably connected across the various upright posts. The side rail system avoids the possibility of a worker accidentally falling through the layers of scaffolding staging.

In an embodiment of the invention, a bolt is utilized for extension through the staging sections and serves as the rods to interconnect to the posts. These same bolts can be used to pass through a U-shaped bar upwardly extending through a slot provided in the support arm of the pump jack. A quick release pin connected between the bar and the bolt secures the two to prevent accidental separation.

In an embodiment of the invention, there is also provided an end rail system which can utilize the same type of bolts and upright posts extending upwardly from the lower section of scaffolding staging. An elongated telescopic rod interconnects the top ends of the posts to the upper layer of scaffolding staging. Mid-rails and toe boards can again be utilized interonnecting the vertical posts. An angled hand rail can extend from the upper rod to a position spaced along the lower scaffolding section to provide additional safety.

The pump jack poles can be utilized internally through coupling connections to permit their extending between an upper and lower surface such as a roof and a floor. Such coupling arrangements include the adjustability of the height of the pole so as to be securely wedged between the support surfaces.

The aforementioned objects, features and advantages will, in part, be pointed out with particularity, and will, in part becomes obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENT

Figure 1:
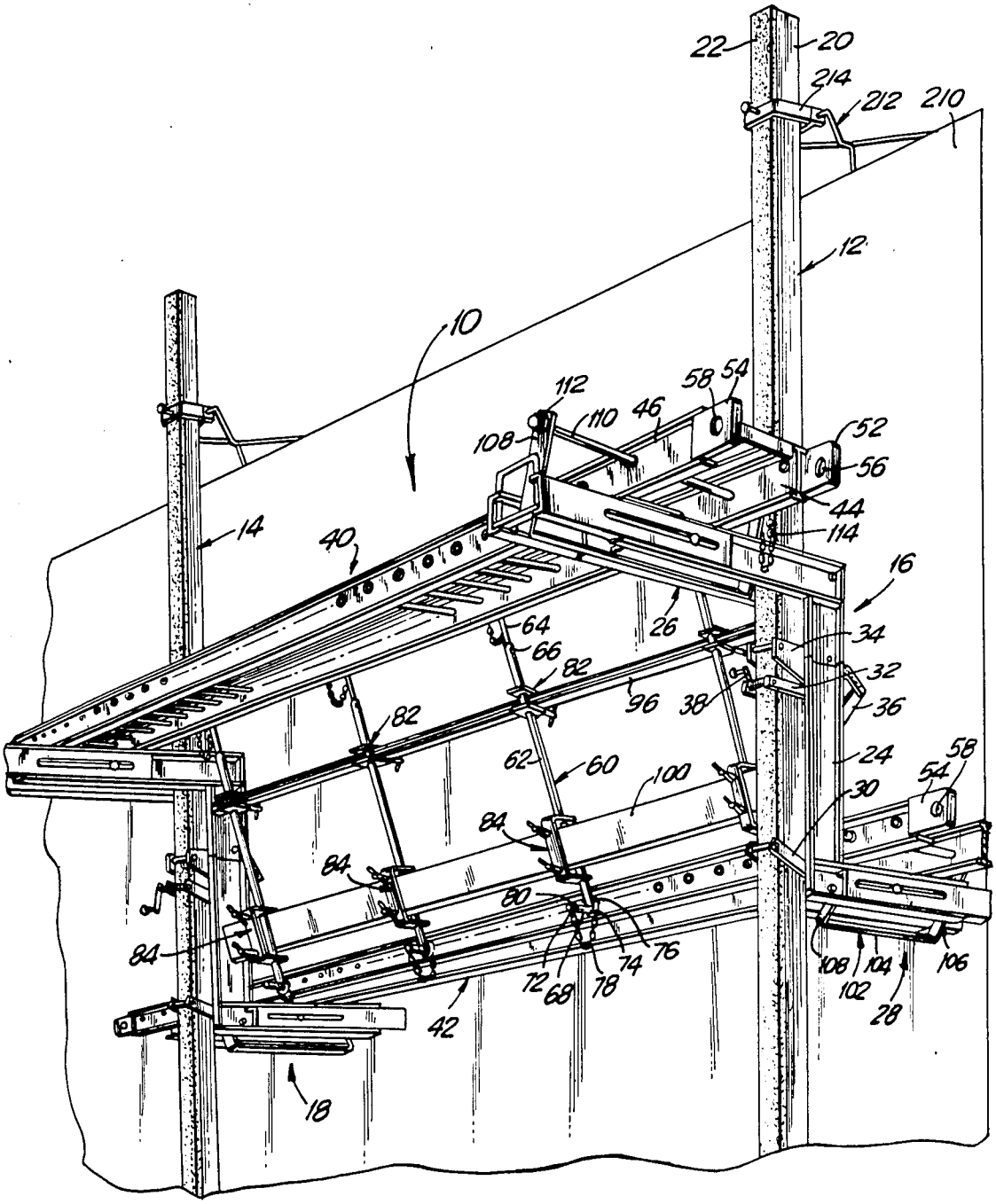
FIG. 1 is a perspective view of a scaffolding arrangement in accordance with the present invention showing the use of the side rail system for interconnecting layered sections of elongated scaffolding staging supported on pump jacks riding on pump jack poles.
Figure 2:
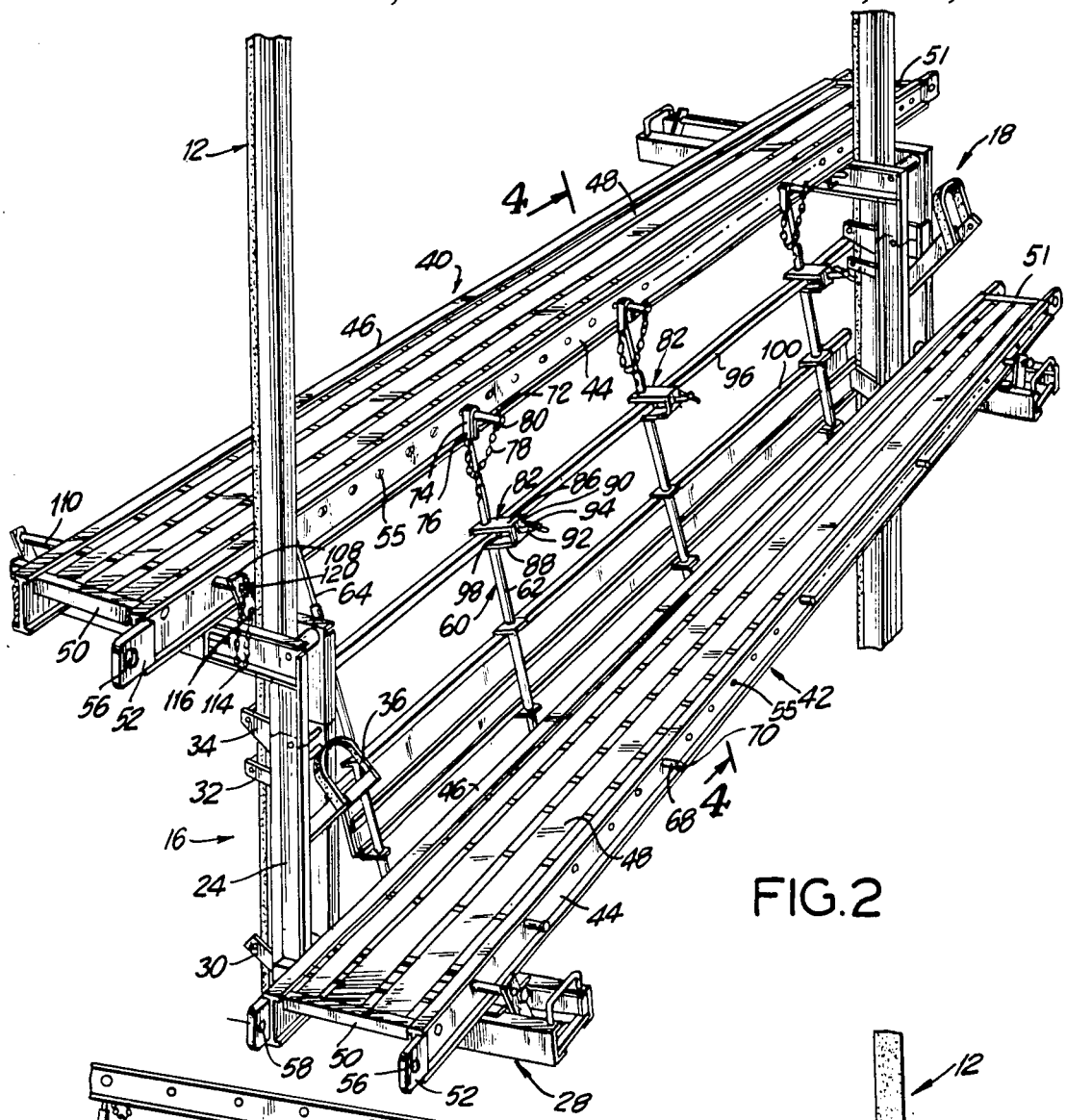
FIG. 2 is a perspective view of the system shown in FIG. 1, and taken from the inside of the scaffolding staging.

Referring now to FIGS. 1–4, there is generally shown a scaffolding system 10 having a pair of spaced apart pump jack poles 12, 14 on which there rides respective pump jacks 16, 18. The pump jack poles 12, 14, are shown to be those described in U.S. Pat. No. 4,382,488. More specifically, each is a substantially rectangular hollow metal pole 20 on which is placed a rubberized surface 22 on one side thereof. Such pump jack poles havebeen found to be easier to utilize, stronger, longer lasting, and more efficient than wooden poles, and the like.

The pump jacks 16, 18, will be described hereinafter in greater detail. However, they operate in accordance with the pump jack described in U.S. Pat. No. 4,463,828. More specifically, they comprise an upright frame portion 24 on which is provided an upper support arm 26 and a lower support arm 28. The pump jack includes a lower shackle portion 30 and an upper shackle portion 32 which surround the pump jack pole. An upper roller portion 34 also surrounds the pole. By means of the pumping arm 36, the pump jack is stepped up the pump jack pole. The over-the-center spring loaded handle 38 is operated to roll the pump jack down the pole.

Two substantially identical staging sections of scaffolding 40, 42 are provided to form the scaffolding platform. The upper section 40 is spanned between the upper support arms 26 of the pump jacks 16, 18. The lower staging section 42 is supported between the support arms 28 of the pump jacks 16, 18. Since the support arms project in opposing directions, the staging sections will be layered and will project in opposing directions from the poles 12, 14.

Each of the staging sections 40, 42 are formed of a pair of opposing side rails 44, 46 formed of I-shaped beams which support a series of slats 48 secured at their opposing ends by means of the bars 50, 52. A plurality of spaced apart hollow rungs 55 secure the opposing side rails 44, 46 in opposition and support the slats 48 to form the platform. At each end of the staging section, there are provided ears 52,54 which can be fastened inside the I-beams providing termination of the staging section. Aligned apertures 56, 58 are provided in the ears 52, 54.

As will be appreciated, with the staging sections positioned on the support arms of the pump jacks, the vertical spacing therebetween is normally empty whereby workers on the lower platform can accidentally slip off the platform. Additionally, stepping from one platform to the other can also cause accidental slippage. This spacing which normally exists between the layers of the platform staging has been one of extreme dangerous condition when utilizing the scaffolding platform.

In order to provide a side rail, the present invention includes a plurality of upright posts 60 formed of a lower portion which is a hollow tubular member 62 and an upper shaft portion 64 which telescopically slides within the tubular portion 62. Indents 66 are provided adjacent the distal edge of the tubular portion 62 which engage projections at the distal end of the shaft portion 64 to prevent complete removal of the shafts of the tubular portion.

Associated with each upright posts 60 are a pair of bolts 68. Each bolt includes an enlarged head portion 70 at one end thereof and a transverse hole 72 at the opposing end thereof. One of the bolts of the pair is inserted through a hollow rung in the lower platform staging 42 so that its distal end projects inwardly toward the post. Another of the bolts is inserted through a hollow rund in the upper staging section 40 and likewise has its distal end projecting inwardly toward the post 60. At both the upper and lower ends of the posts, there is provided a U-shaped collar 74 which is pivotally secured to the post by means of a pivot pin 76. The collar is arranged to receive the distal end of the rod projecting from the corresponding platform staging section.

The pivot pin 76 also serves to secure one end of a connecting chain 78. At the other end of the connecting chain is provided a quick release pin, of a type well known in the art. Such quick release pins 80 typically include a plunger for insertion and removal of the pin within an aperture. Upon release of the plunger, the pin is secured within the aperture. The quick release pins 80 are inserted in the transverse bolt 72 provided at the distal ends of the rods 68.

It should therefore be appreciated, that each upright post 60 is held by means of the rods projecting through the upper and lower platform staging where the rods pass through the collar portion and are held by means of the quick release pin inserted in the hole at the end of the rods. Because of the pivotal arrangement of the collar, and because the rods can easily pass through the collar, the upright post 60 can be angularly oriented at a desired angular position to accommodate placement of the platform sections at various orientations with respect to each other. Furthermore, because of the telescopic arrangement, the post can be also adjusted to accommodate proper vertical spacing between the sections of staging.

Adjustably connected onto each upright post 60 is an upper U-shaped clamp member 82 and a lower U-shaped clamp member 84. The upper clamp member is in the form of a U-shaped arrangement having opposing upper and lower legs 86, 88 with an interconnecting bight portion 90. A bolt 92 having a wing handle 94 is threadingly screwed into the bight portion 86. A pair of opposing apertures are formed at the distal ends of the legs 86, 88 for receiving therethrough the upright post 60.

The individual clamps 82 are all placed at approximately the same height along the upright posts. A midrail 96 is then slidably inserted between each of the clamps 82 and the post 60. The rails are securely retained in the passageway defined between the upper and lower arms 86, 88 and retained clamped in position between the upright post 60 and the front end of the threaded screw 92. A bearing plate 98 can be added at the front end of the screw 92 to securely clamp the mid rail 96 in place.

The lower clamp 84 is again formed of similar construction to the upper clamp 82. The difference being that it has two clamping screws extending through its bight portion and has a wider channel defined between the opposing legs. A larger toe board 100 is slid through the lower clamps 84 and retained in place clamped against the upright posts 62.

It should be appreciated, that the clamps 82, 84 serve simultaneously to clamp the midrail or toe board in place and at the same time also secure the clamp itself in proper position along the appropriate height of the upright post. The midrail serves to prevent the worker from falling through the mid section of the opening between the two layers of staging. The toe board serves to prevent the foot from accidentally slipping off the edge of the scaffolding staging.

It should be appreciated, that the construction of the upright posts, the bolts, and the clamps, are such as to permit the workers to connect the side rail system while positioned on the scaffolding itself. Specifically, each of the bolts can be easily inserted from an outer end of the scaffolding staging through one of the hollow rungs so that the inner end projects from the staging. The upright posts can then be easily inserted so that their collars slip over the projecting ends. Since both projecting ends of the bolts will face inwardly towards the middle between the two staging sections, a worker standing on either the upper or lower staging can easily adjust the upright posts to fit over the projecting end of the bolts. The quick release pins can then be easily inserted to lock the posts in place.

Likewise, the screws on the upper clamps 82 can be easily adjusted by a worker standing on either the upper or lower scaffolding staging. The screws on the lower clamps 84 can be adjusted by standing on the lower staging and reaching over to tighten the clamps.

As the levers 36 are operated on the pump jacks to move the pump jacks up and down the pump jack poles, the staging sections will move upward and downward along with the pump jacks. Since each end of the sections rests on opposing arms of the same pump jack, they will both move at the same time maintaining the height therebetween so that the side rail system can be retained once the staging has been set on the support arms of the pump jack.

The same bolts utilized to interconnect to the side rail, can also be utilized to lock the staging to the support arms. Specifically, as best shown in FIGS. 1, 2, 3, and 6, the staging support arms 26, 28 are constructed so as to provide a vertical slot therein. A substantially U-shaped bar shown generally at 102, is inserted so that the bight portion 104 of the bar is upwardly inserted into the vertical slot in the support arms with the opposing side arms 106, 108 of the bar straddling the scaffolding staging on either side of the side rails 44, 46. The bight portion is restrained from complete movement upward through the slot by means of transverse posts positioned in the vertical slots of the support arms, as will hereinafter be described.

At the distal ends of the arms 106, 108, are provided a pair of aligned bores through which a bolt 110 can be inserted. The bolt is inserted through the aligned bores in the arms 106, 108, as well as through the hollow sleeve of one of the rungs in the scaffolding sections. An enlarged head 112 at one end prevents complete passage of the bolt so that it is restrained at one end of the scaffolding section. As shown in the upper left hand corner of FIG. 2, a chain 114 can be secured by means of a rivet 116 directly to one arm 108 of the U-shaped bar and a quick adjust pin 120 attached to the end of the chain. The pin can then be inserted in the transverse bore at the distal end of the bolt 110 so as to secure the bolt in place and prevent its removal from the scaffolding staging.

Figure 6:
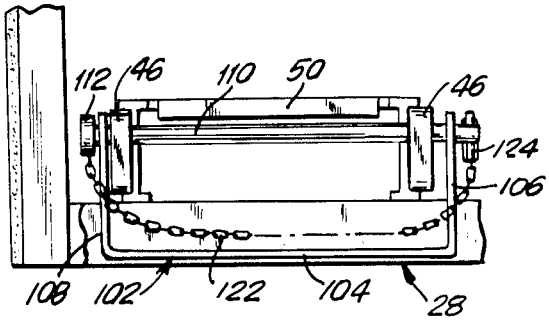
FIG. 6 is a partial elevational view showing an alternate embodiment for interconnecting the scaffolding staging to the support arm of the pump jack.

As shown in FIG. 6, instead of providing the chain on the U-shaped bar, a chain 122 can be connected directly to the enlarged head 112 so that it passes beneath the scaffolding railing and inserts the quick adjust pin 124 into the transverse hole at the distal end of the rod 110.

It should therefore be appreciated, that the same type of bolts with the same enlarged head and transverse bore at opposing ends can be utilized both to connect to the upright posts as well as for connection to the U-shaped bar. The bolt connected to the U-shaped bar locks the bar in place so as to prevent the staging from removal from the support arms.

Figure 3:
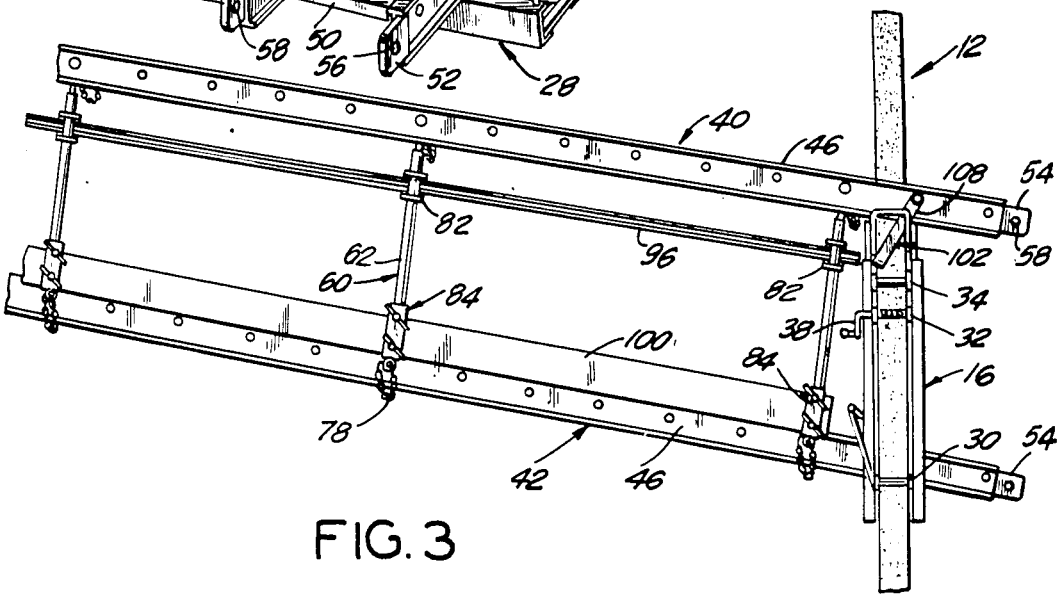
FIG. 3 is a partial view of the scaffolding arrangement shown in FIGS. 1 and 2, and demonstrating the ability of angularly orienting the scaffolding system.
Figure 4:
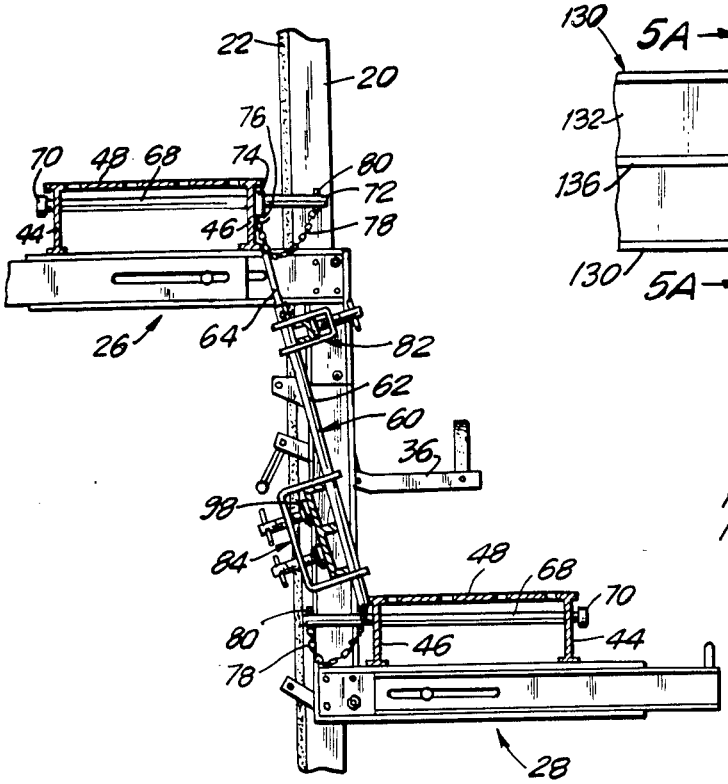
FIG. 4 is a cross sectional view taken through lines 4—4 of FIG. 2.

As noted in FIG. 1, the bight portion 104 of the U-shaped bar 102 is positioned sufficiently beneath the vertical slot so as to be able to have sufficient upward movement during angular orientation of the side rail. As shown in FIG. 3, during upward movement of the pump jack, each of the pump jacks are moved separately up the pump jack pole. Therefore, for a time during the upward movement of one end, the entire scaffolding will be angularly oriented. Because there is sufficient room in the bar 102 with respect to the support arm, the bar 102 can be angularly oriented as shown in FIG. 3 so as to retain the side rail secured and at the same time permit angular orientation. It should also be appreciated that at some times it will be necessary to keep the scaffolding at an angular position and, because of the unique U-shaped connecting bar arrangement with the locking bolt, the scaffolding will still be held secured in place on the support arms.

By using the quick release pins, connection of the system as well as removal of the system is simplified and at the same time the quick adjust pins provide adequate secure connection to lock the portions in place.

Figure 5:
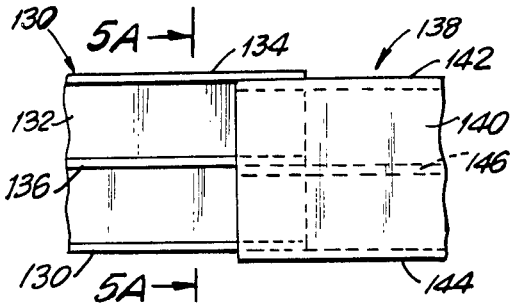
FIG. 5 is a partial elevational view of interconnected toe boards supported by the rail system shown in FIG. 1.
Figure 5A:
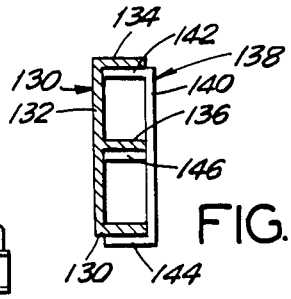
FIG. 5A is a cross sectional view taken along lines 5A—5A of FIG. 5.
Figure 5B:
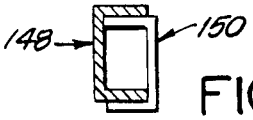
FIG. 5B is a cross sectional view similar to that shown in FIG. 5A however showing the use of interconnected mid rails.

Referring now to FIGS. 5, 5A, and 5B, it should be appreciated that although just one section of scaffolding staging was shown, the staging can actually be interconnected to extend at great lengths. When providing interconnecting sections of staging, it will also be necessary to provide the side rails in a continuous fashion from section to section. This can be achieved by overlapping the midrails and the toe boards so as to provide a secure connection. Specifically, as shown in FIGS. 5 and 5A, a first toe board 130 is shown to be formed of a channel member having a vertical wall 132 with upper and lower inwardly directed flanges 134, 136 and a mid flange 136. The toe board 130 is connected with the flange portions facing in an outwardly oriented direction.

A second toe board 138 is also provided. This toe board again has a vertical section 140 with upper and lower flanges 142, 144 and a mid flange 146. This toe board is positioned so that the flanges are inwardly directed and interfit the flanges of the first toe board 130. Interfitting of these toe boards permit an interlocking relationship between them.

The lower clamps 84 can be positioned so that the clamp always abut against the vertical walls. Therefore, in one case the clamps will be facing in one direction with respect to the posts while in the case with the toe board in the opposing direction, the clamps will be facing in the opposite direction.

As shown in FIG. 5B, two midrails 148 and 150 can also be interconnected. Each of the midrails are formed of a C-shaped channel and their opposing legs are staggered so that they will each face in opposing directions. In this manner, both toe boards and midrails can be joined end to end in a continuous extension with the ends overlapping. This permits the scaffolding staging to be extended at considerable lengths and for the side railing to be attached in a secure fashion.

Figure 7:
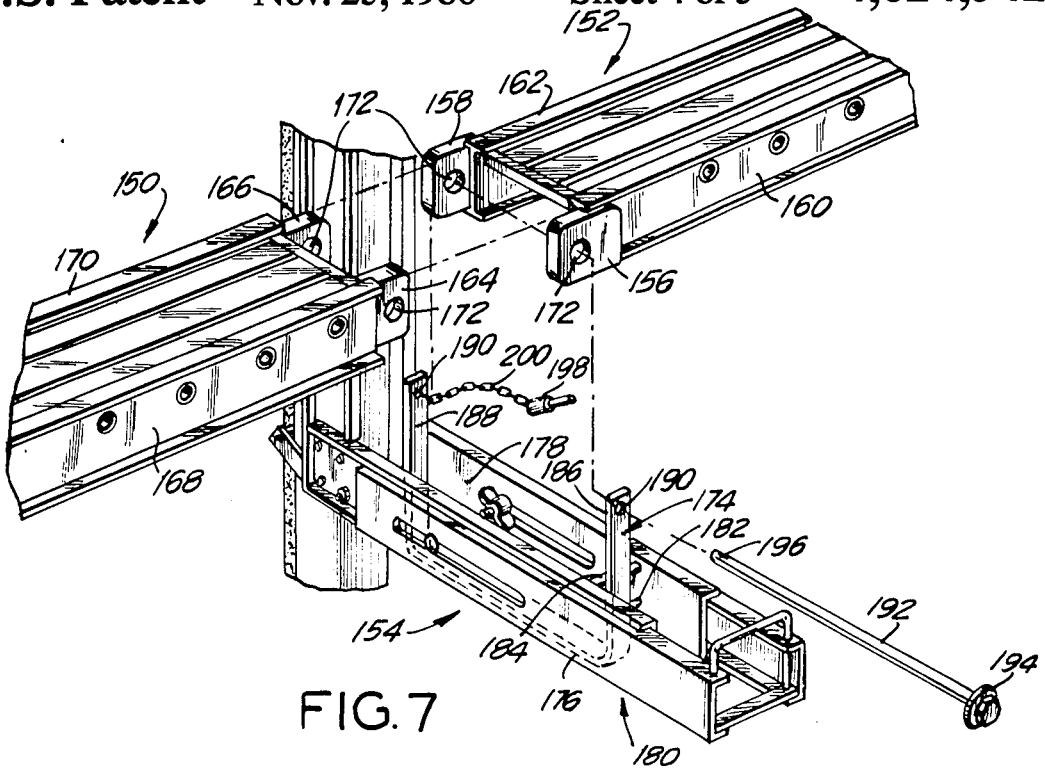
FIG. 7 is an exploded perspective view of an arrangement for interconnecting two elongated staging sections of a scaffolding platform.

Referring now to FIG. 7 it will be shown that the same type of clamping arrangement heretofore described in connection with securing the staging to the support arm can also be used for interconnecting sections of scaffolding staging. As shown, a first section of scaffolding staging 150 and a second section 152 are interconnected to be supported on a common support arm 154. Each of the scaffolding staging is of the type heretofore described. The interconnection of the scaffolding staging is similar to that described in U.S Pat. No. 4,499,967.

As pointed out, the staging is arranged so that at one end the ears 156, 158 are placed outwardly of the I-beams 160, 162. On the other end, the ears 164, 166 are placed inwardly of I-beam 168, 170. By constructing each section of scaffolding staging so that at one end the ears are on the outside of the I-beams and at the other end the ears are on the inside of the I-beams, all staging sections are substantially identical. However, this permits an interfitting relationship to abut ends of the scaffolding sections. As shown, the inward ears 164, 166 can be placed so that they fit on the inside of the ears 156, 158.

All of the ears have aligned bores 172. With the ears all interfitted, the various aligned bores 172 provide a common passageway.

With the ears positioned on the support arms, a U-shaped bar 174, similar to the type heretofore used to connect the railing to the support arm, is now also used to interconnect the two sections of scaffolding. The U-shaped bar 174 is inserted so that the bight portion 176 is upwardly inserted through the bottom of the slot 178 formed in the horizontal support arm shown generally at 180. The transverse posts 182, 184 formed internally of the slot 178 serve to prevent complete upward movement of the bight portion 176.

The opposing arms 186, 188 of the bar 174 are positioned to straddle the ears. Aligned bores 190 formed in the distal ends of the arms 186, 188 are coaligned with the bores 172. A bolt 192 is then inserted through the coaligned bores 190 and 172. An enlarged head 194 prevents complete insertion of the bolt. A transverse hole 196 is formed at the distal end of the bolt. A quick release pin 198 is connected by means of a chain 200 to one arm 188 of the U-shaped bar 174. With the bolt completely inserted, the quick release pin 198 is passed through the transverse hole 196 in the bolt to lock the bolt in place.

By means of the quick release pin, and the described arrangement it is thereby easy to interconnect two elongated scafolding sections which are abutted together and supported on the support arm of the pump jack. The same type of bolts, quick release pins, etc, which are used for the side rail system and for connecting the scaffolding staging to the support arms is also used to abut the staging sections.

Figure 9A:
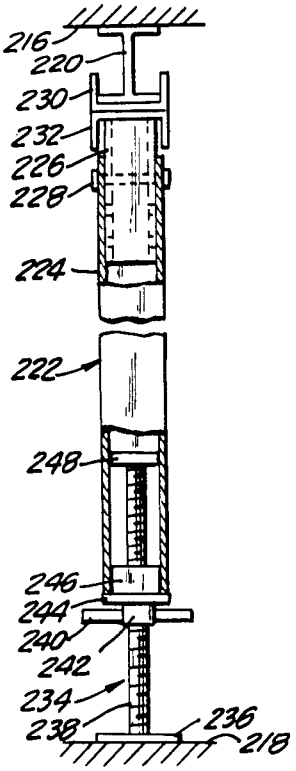
FIGS. 9A, 9B, and 9C show schematically various connection arrangements for utilizing a pump jack pole between upper and lower support surfaces such as a floor and a ceiling.
Figure 9B:
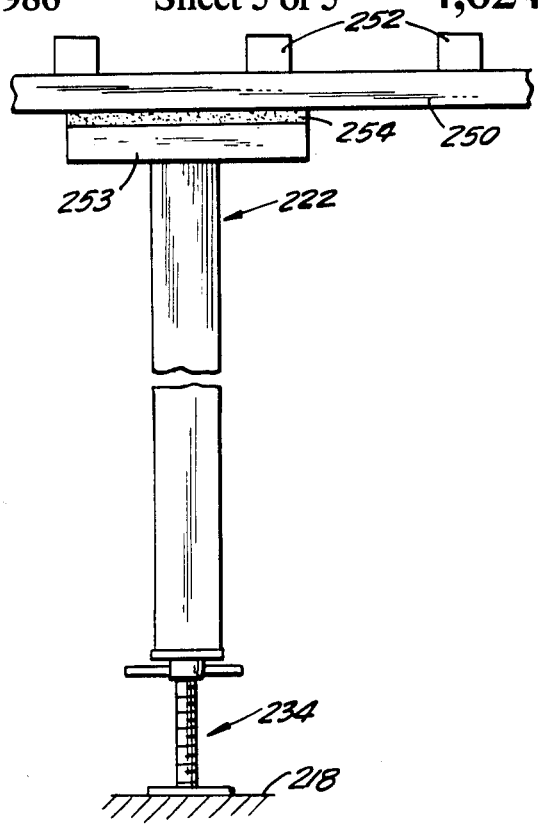
Figure 9C:
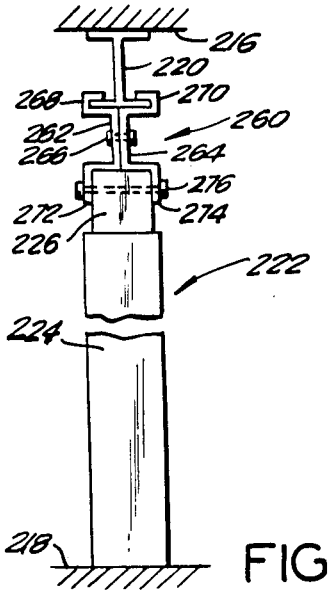

As shown in FIG. 1, the pump jack poles 12 are interconnected to the exterior of a wall 210 by means of a brace 212 held by means of a clamp 214. The brace is of the type described in the aforementioned U.S. Pat. No. 4,446,945 and the clamp is of the type described in U.S. Pat. No. 4,432,435. Such arrangements would be useful for connecting the pole to the exterior surface of the building. However, the poles can also be utilized internally of a building. For example, as shown in FIGS. 9A, 9B, and 9C, the pole can be used so as to space it between an upper support such as a ceiling 216 and a floor 218. On the ceiling there are sometimes included I-beams 220 and the pole can be spaced between the I-beam and the floor 218.

In the arrangement shown in FIG. 9A, the pole itself shown generally at 222 is of the type previously mentioned and described in U.S. Pat. No. 4,382,488. In such patent, it was described that the pole can include a hollow metal portion 224 and can also include a splint 226 which can be telescopically received in the pole 224 and adjusted by means of a bolt 228 at an appropriate height. Accordingly, the pole can be placed so as to approximate its height between the I-beam 220 and the floor 218.

At the upper end of the pole, the pole will be held by means of opposing U-shaped clamps. An upper U-shaped clamp 230 is seated on a lower inverted U-shaped clamp 232. These members can be just butted together and serve as seats. The clamp 230 fits around the lower face of the I-beam 220 and the clamp 232 caps on top of the splint 226. These need not be secured in place but are held in place by wedging of the pole.

At the lower end, a level adjusting screw 234 is utilized so as to tightly wedge the pole in place. The level adjustment includes a mud plate 236 with a screw 238 that can be rotated by means of the handle 240 connected by means of a hub 242. An upper plate 244 fits onto the base of the pole 222 with the plug 246 inserted in the pole. At the upper distal end of the screw there is provided a spacer block 248.

By tightening the handle 240, the pole 222 can be wedged in place between the I-beam 220 and the ground 218. It should be noted, that no fastening members are required since the upper U-shaped members simply sit in place without any bolting and at the lower end the screw simply tightens the pole in place. Nevertheless, once secured, the pole will remain extremely tight. The pole can now be used for supporting scaffolding similar to the type shown in FIG. 1 and heretofore described.

Where the upper celing does not include any I-beams, as shown in FIG. 9B, the pole can be wedged in place between the ceiling itself and the floor. Specifically, the ceiling shown is a solid ceiling 250 having beams supporting it 252. Between the pole 222 and the ceiling 250 there can be placed a rigid plate 253 beneath which is included a foam rubber plate 254. These serve as cushions for the upper end to prevent damage to the ceiling and also to hold the top rigid without sliding. At the bottom end there is again provided the level adjustment 234 to wedge the pole in place between the floor 218 and the ceiling 250.

As shown in FIG. 9C, another type of arrangement is shown to connect the pole 222 between the ceiling 216 and the floor 218. An I-beam is provided on the ceiling. In this case, the pole is adjusted so that the extending splint 226 projects from the sleeve 224.

A top beam lock is provided at 260 to interconnect the pole to the I-beam. The beam lock comprises two C-shaped clamps 262 and 264 which are connected in back to back relationship and secured by means of a center rivet or bolt 266. At the upper end of each of the clamps is provided a U-shaped member 268, 270 which fits over the lower edge of the I-beam. At the bottom end of each of the clamps is provided a downwardly depending leg 272, 274 through which passes a bolt 276 which also extends through the splint 226. With this beam lock arrangement, the pole is secured to the beam and simply hangs down until it reaches the floor 218. A mud plate can be provided at the bottom if needed.

With each of the arrangements as shown, the pump jack pole could be used internally in an industrial plant, warehouse, marine environment, or the like. The pump jacks could be used to ride up and down the poles and the appropriate scaffolding arrangement could be placed as heretofore descirbed.

Figure 8:
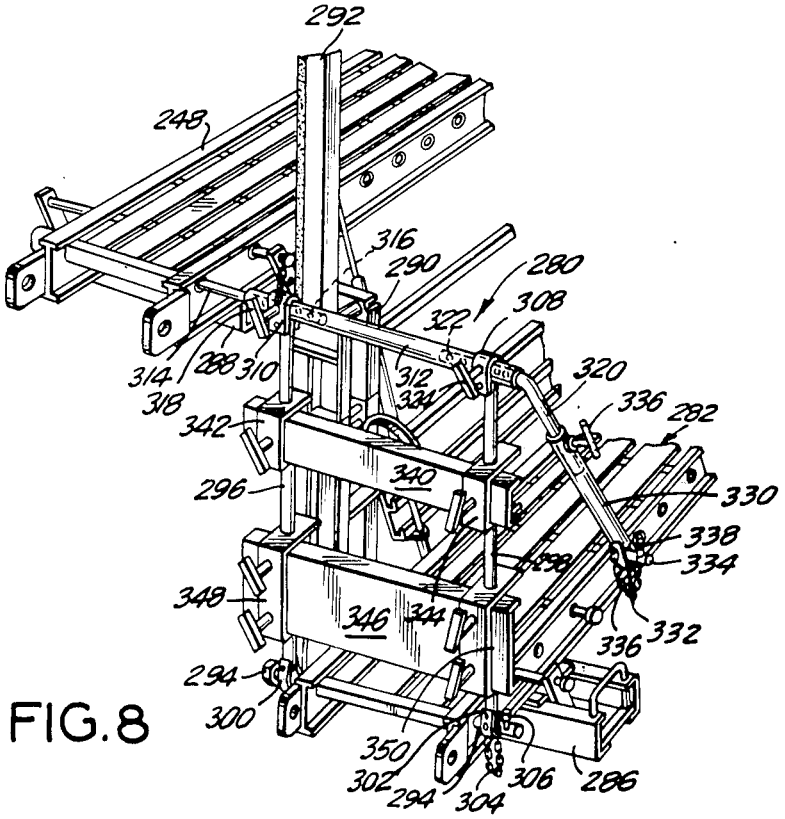
FIG. 8 is a perspective view of an end rail system for use in conjunction with the side rail system for interconnecting layered sections of elongated scaffolding staging supported on pump jacks riding on pump jack poles.

As shown in FIG. 8, the same type of rods and posts heretofore utilized in FIGS. 1–4 for the side rail, can also be similarly utilized for an end rail. The end rail, shown generally at 280 would be utilized for closing off the end of a section of scaffolding staging in order to prevent a worker from falling off the edge. As is shown, a lower platform of scaffolding staging 282 and an upper platform of scaffolding staging 284 are respectively held on the arms 286, 288 of a pump jack 290 which rides up and down the pump jack pole 292. The end rail system comprises a bolt 294, of the type previously described which passes through a sleeve 294 serving as one of the hollow rungs in the lower staging section 282. The vertical upright rods 296, 298 have their lower U-shaped strap portions 300, 302 respectively receiving passage of the bolt 294 therethrough with the rods 296, 298 being laterally outward of the scaffolding section 282. The rod is secured in place by means of the chain 304 which can be attached either to the rod or the posts and having a quick release pin 306 at the end thereof which fits into an aperture formed at the end of the bolt 294.

At the upper end of the posts 296, 298 there are again provided a pair of U-shaped sleeves 308, 310 through which pass a hollow rod 312. The hollow rod 312 can receive at one end therethrough a bolt 314 which passes through a hollow rung in the upper scaffolding staging 248. The end of the bolt 314 is telescopically received within the sleeve 312. A series of apertures 316 can be formed at the end of the bolt 314. A single aperture can be formed in the distal end of the sleeve 312. By placing a screw type clamp 318 through the U-shaped yoke 310, the rod 314 can be secured in place within the hollow sleeve 312 and locked in position.

At the opposing end of the sleeve 312 there can be placed an L-shaped rod 320. The upper end can have a series of apertures 322 formed therein and by placing a single aperture at the end of the hollow sleeve 312 and again utilizing a screw clamp arrangement 324, the upper end of the L-shaped rod can be secured in place at an appropriate location.

By means of the sleeve and the telescopic arrangement at opposing ends, the same sleeve can be utilized with varying widths of scaffolding section. By extending outwardly the position of the opposing rods 314, 320 at either end of the sleeve 312, the same end rail can be utilized for scaffolding of different width sizes.

The end of the rod 320 is again received in a sleeve 330 having its lower end secured by means of a U-shaped yoke 332 around another bolt 334. Again, the chain 336 and the quick release pin 338 are utilized to secure the bolt in place. A screw clamp arrangement 336 at the upper end of the sleeve 330 can again clamp the rod 320 in place by means of appropriate apertures through which the clamping screw 336 would be inserted.

Standing between the two vertical posts 296, 298, there can again be placed a mid-rail system 340 which can be secured again by means of opposing U-shaped clamping members 342, 344 similar to that heretofore shown with regard to the side rail. Similarly, a lower toe board 346 can be again secured in place by means of a pair of opposing U-shaped clamping members 348, 350 similar to that heretofore described in connection with the side rail system.

It should therefore be appreciated, that the same kind of bolts, rods, toe boards, mid rails, and clamps can be utilized to form an end rail system just as was heretofore described in connection with a side rail system. Furthermore, not only is the end closed off, but by means of the L-shaped rod 320 and correspondingly receiving sleeve 330, a hand rail can be provided to provide further enclosure at the edge and at the same time provide support for the end rail to prevent someone from falling over the edge even should they be leaning against the end rail.

There has been described heretofore the best embodiment of the invention presently contemplated. However, it is to be understood that various changes and modifications may be made thereto without departing from the spirit of the invention.

I claim:

1. An interconnected scaffolding platform, comprising:

at least two elongated staging sections to be butted together and supported on a support member having a vertical receiving slot therein with a transverse stop thereacross;

a pair of end portions longitudinally projecting from the confronting ends of each section, each pair being staggered with respect to the other pair, so as to permit a mating interfit of the two pairs of end portions;

each of said end portions having a transverse bore therethrough, said bores being aligned in the interfit position of the end portions so as to define a passageway transverse to the sections, and coupling means for extending through said passageway to securely interconnect said sections together, whereby the interconnected sections will lie colinearly in a common plane, said coupling means comprising a U-shaped bar having a bight portion and a pair of legs, said legs upwardly projecting through said slot so as to straddle said end portions with said bight portion restrained by the transverse stop, aligned bores formed in the distal ends of said legs, a bolt extending through said aligned bores and said passageway, and enlarged head at one end of said bolt preventing complete passage through said aligned bores, a transverse hole at the other end of the bolt, and pin means slidably insertable into the transverse hole for preventing removal of said bolt.

2. An interconnected scaffolding platform as in claim 1, wherein said pin means comprises a quick release pin, and further comprising a chain coupling said quick release pin to said U-shaped bar.

3. An interconnected scaffolding platform as in claim 1, wherein said pin comprises a quick release pin, and further comprising a chain coupling said quick release pin to said bolt head.

4. An interconnected scaffolding platform as in claim 1, wherein the length of said legs is greater than the height of the vertical receiving slot and the scaffolding, to provide sufficient slack to permit angular orientation of the scaffolding platform.

* * * * *